US005570170A

United States Patent [19]

Muranyi et al.

[11] Patent Number: 5,570,170

[45] Date of Patent: Oct. 29, 1996

[54] ELECTROSTATIC PRINTING APPARATUS WITH A HOPPER AND APPLICATOR ROLLER WITH METHOD OF APPLYING TONER TO AND DECLUMPING THE APPLICATOR ROLLER

[75] Inventors: Mark J. Muranyi, Grand Island; Dennis C. Pollutro, Cherry Creek; T. F. Cyman; Kevin J. Hook, both of Grand Island; Orrin D. Christy; Mark A. Matheis, both of North Tonawanda, all of N.Y.

[73] Assignee: Moore Business Forms, Inc., Grand Island, N.Y.

[21] Appl. No.: 173,073

[22] Filed: Dec. 27, 1993

[51] Int. Cl.[6] ..... G03G 15/06

[52] U.S. Cl. ..... 355/260; 118/654; 355/253; 355/255; 355/256

[58] Field of Search ..... 355/260, 253, 355/245, 255, 256, 251, 264, 259; 118/654, 657, 658, 653; 222/DIG. 1; 354/324

[56] References Cited

U.S. PATENT DOCUMENTS

| | | | |
|---|---|---|---|
| 3,008,826 | 11/1961 | Mott et al. | 118/654 X |
| 3,707,390 | 12/1972 | Sullivan, Jr. | 118/654 X |
| 4,027,607 | 6/1977 | Pan et al. | 118/654 X |
| 4,124,287 | 11/1978 | Bean et al. | 118/657 X |
| 4,213,617 | 7/1980 | Salger | 118/654 X |
| 4,241,696 | 12/1980 | Huzii | 118/691 |
| 4,246,588 | 1/1981 | Binder | 118/657 X |
| 4,431,296 | 2/1984 | Haneda et al. | 355/249 |
| 4,647,180 | 3/1987 | Watanabe | 355/246 |
| 4,668,074 | 5/1987 | Hirozane | 355/203 |
| 4,752,807 | 6/1988 | Mort | 355/260 |
| 4,777,106 | 10/1988 | Fotland et al. | 118/654 X |
| 4,942,432 | 7/1990 | Mort et al. | 355/260 |
| 4,945,956 | 8/1990 | Bueyuekgueclue et al. | 355/260 X |
| 4,977,429 | 12/1990 | Tani et al. | 355/260 |
| 5,077,584 | 12/1991 | Tanaka et al. | 355/260 |
| 5,128,723 | 7/1992 | Bolte et al. | 355/259 |

FOREIGN PATENT DOCUMENTS 2059036 7/1992 Canada .

OTHER PUBLICATIONS

Romankiw, "Fluidized Bed Printer and/or Copier", Jul. 1975, pp. 572–574, IBM Tech. Disc. Bulletin.

*Primary Examiner*—Arthur T. Grimley
*Assistant Examiner*—Shuk Yin Lee
*Attorney, Agent, or Firm*—Nixon & Vanderhye

[57] ABSTRACT

Electrically conductive magnetic toner is supplied to an electrostatic printing apparatus by dispensing it pneumatically from one of two different toner bottles mounted on dispenser blocks. The toner passes through a chute into a container having an air previous, toner impervious, bottom. The toner particles are fluidized in the container, and come into contact with the rotating surface of an applicator roller having interior magnets, and the amount of toner which stays on the applicator roller surface is controlled in part by rotating the surface past a metering blade. To periodically declump the toner, a mechanical element is depressed which reverses the direction of the applicator roller, and brings a scraper blade into contact with the surface of the applicator roller, and applies a high level of vacuum to remove scraped off toner.

34 Claims, 5 Drawing Sheets

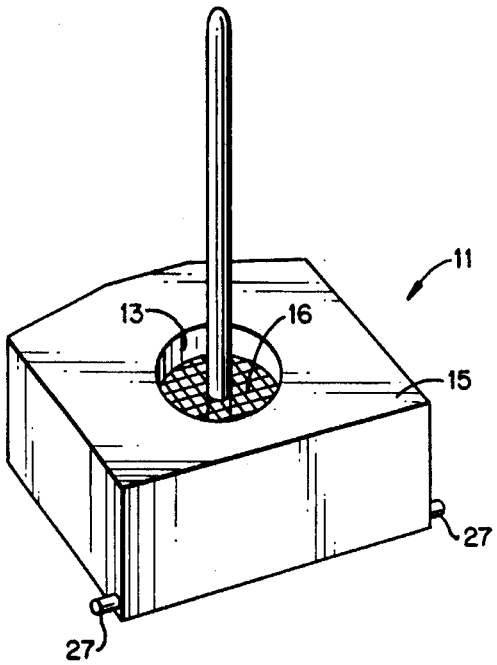
FIG. 4
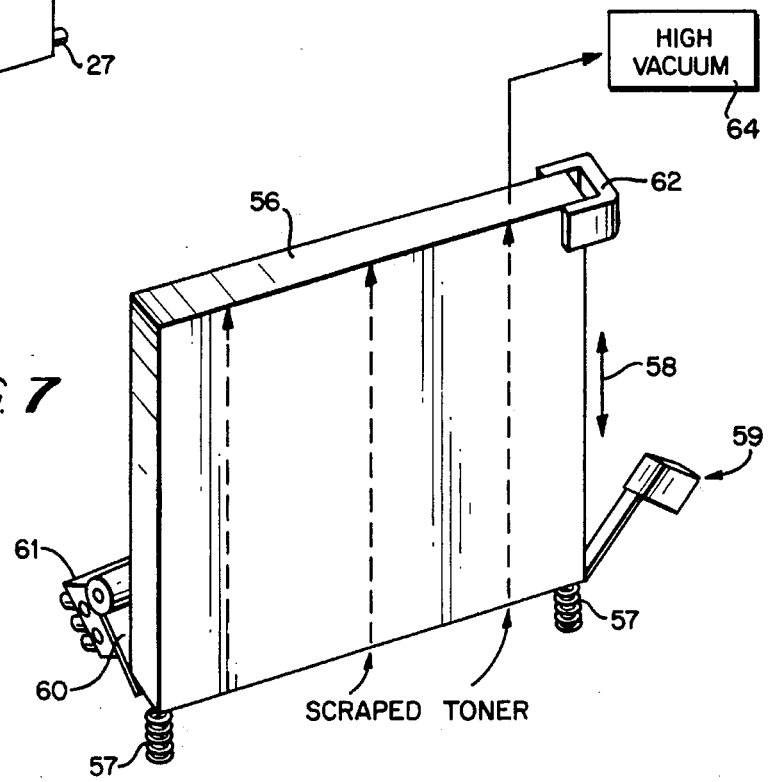
FIG. 7
FIG. 8
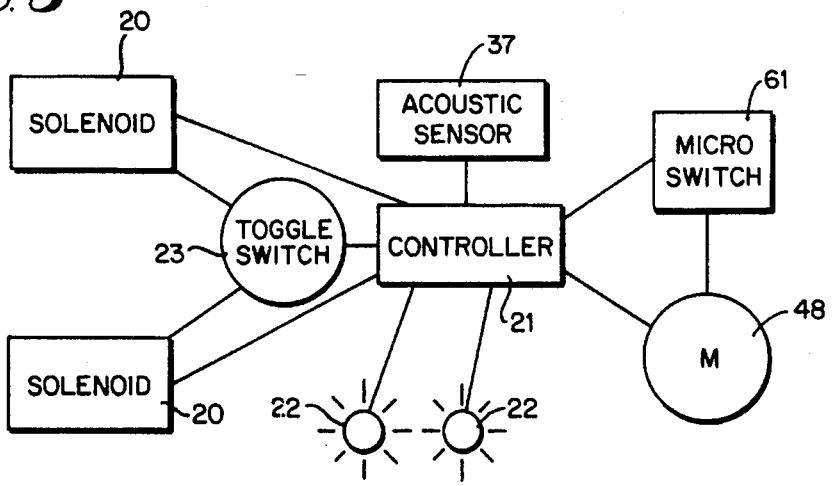

ELECTROSTATIC PRINTING APPARATUS WITH A HOPPER AND APPLICATOR ROLLER WITH METHOD OF APPLYING TONER TO AND DECLUMPING THE APPLICATOR ROLLER

BACKGROUND AND SUMMARY OF THE INVENTION

For some electrostatic printing processes, such as the MIDAX® process, it is necessary to dispense electrically conductive and magnetic toner. In conventional systems for doing this, there can be substantial problems associated with clumping of the toner. Also, it is difficult to reliably supply the toner to ensure that a sufficient amount is always available for the printing elements.

According to the present invention, an apparatus and method for ultimately supplying toner for electrostatic printing which minimize the possibility of clumping, enhance print quality and reduce edge dusting, utilize a minimum of moving parts, make printing set up easier, and reduce the time needed to make adjustments, are provided. Also according to the invention reliability is improved, as well as compatibility with magnetic color toner.

The basic supply of toner utilized in the practice of the invention is a fluidized bed. The mechanism for fluidizing the toner in the bed may be similar to that in Canadian published patent application 2059036, the disclosure of which is hereby incorporated by reference herein. However numerous changes need be made to properly supply the magnetic and conductive toner according to the invention, which is distinct from the non-magnetic and nonconductive toner set forth in the Canadian patent application.

The components of the apparatus according to the invention include a hopper assembly with two different dispenser blocks, each for mounting a bottle of toner, and for delivering the toner through a common chute into a container in which the toner is fluidized. The toner is dispensed from the bottles by supplying gas under pressure to a sintered stainless tube that extends upwardly into each of the bottles, one bottle being exhausted before controls automatically start dispensing toner from the second bottle, and indicator lights being provided to indicate when a bottle is being emptied. In the fluidized bed, the chances of the toner clumping are minimized, and the toner is withdrawn from the bed by a rotating external surface of a magnetized applicator roller. The applicator roller rotates in association with a metering blade to control the amount of toner that is removed with the roller. If poor imaging in one area of the electrostatic printing apparatus indicates a clump, a declumping procedure can be implemented.

According to one aspect of the present invention, a hopper assembly is provided for supplying toner to an electric printing apparatus. The assembly comprises: A first dispenser block comprising a body having a central passage, means for receiving an open end of a toner bottle in the central passage, a screen (e.g. 60 mesh) in the central passage adjacent the toner bottle receiving means, and a gas permeable but toner substantially impermeable tube (e.g. of sintered stainless steel) extending through the toner bottle receiving means a significant distance past the block, so as to penetrate (into a bottle received by the toner bottle receiving means) a distance significant enough to effect fluidization of toner in the bottle to effect discharge thereof through the screen. Means for mounting the first dispenser block in association with an electrostatic printing apparatus.

Means for connecting the tube to a source of gas under pressure. And, a passage exterior of the dispenser block for guiding toner from the screen to an electrostatic printing apparatus.

The assembly also preferably comprises a second dispenser block substantially identical to the first block, and also with associated mounting mechanisms and control means. The toner is typically supplied from the dispenser blocks through a chute with an acoustic sensor for sensing the level of toner in the bed.

According to another aspect of the present invention an electrostatic printing apparatus is provided which comprises the following elements: A supply of conductive magnetic toner. A container for a fluidized bed of conductive magnetic toner. Means for automatically replenishing toner withdrawn from the fluidized bed from the supply. Means for fluidizing the toner in the container. A single applicator roller adjacent the container, and having an external surface thereof which extends into the container, the applicator roller including magnetic elements. Means for rotating the applicator roller about a horizontal axis. And, a metering blade cooperating with the applicator roller external surface for metering the conductive magnetic toner on the external surface.

The rotating means for the electrostatic printing apparatus comprises a reversible electric motor, and a declumping apparatus effects reverse rotation of the applicator roller while bringing a scraping blade into contact with the applicator roller, while simultaneously applying a vacuum to it.

According to another aspect of the present invention a method of applying conductive and magnetic toner to an applicator roller having magnets therein (an internal magnetic member) is provided. The method comprises the steps of: (a) Supplying powdered conductive magnetic toner to a container to maintain a predetermined level therein. (b) Maintaining the powdered toner in a fluidized bed in the container. And, (c) moving a non-magnetic rotating surface into operative association with the magnetic toner in the fluidized bed to collect toner thereon in the presence of magnetic fields from an internal magnetic member and remove it from the fluidized bed.

Step (a) is preferably practiced pneumatically, by fluidizing the powdered toner so that it will pass through a screen (e.g. a 60 mesh screen), and step (b) is practiced by passing fluidizing gas through a substantially horizontal sintered metal surface.

The invention also includes as another aspect thereof a method of declumping toner associated with an applicator roller having an external surface, of an electrostatic printer, which roller normally rotates in a first direction. The method comprises the steps of: (a) Temporarily reversing the direction of rotation of the applicator roller so that it rotates in a second direction opposite the first direction. And, (b) while practicing step (a), automatically scraping the exterior surface of the applicator roller while simultaneously applying vacuum thereto, to remove toner from the exterior surface. Steps (a) and (b) are preferably practiced for a time period of about 3–10 seconds (e.g. 4 to 5 seconds) by manually depressing an element which engages a microswitch which changes the direction of rotation of the roller, while bringing a scraping blade into contact with the external surface of the roller, and bringing a high level vacuum into close proximity thereto.

It is the primary object of the present invention to effect simplified, reliable, and practical supply of conductive and magnetic toner to an electrostatic printing apparatus. This and other objects of the invention will become clear from an inspection of the detailed description of the invention and from the appended claims.

BRIEF DESCRIPTION OF THE DRAWINGS

FIG. 4 is a top perspective view of an exemplary dispenser block of the apparatus of FIGS. 1 through 3;

FIG. 7 is a schematic view showing the declumping housing element of the apparatus of FIGS. 1 through 3;

FIG. 8 is a control schematic for the apparatus of FIGS. 1 through 3.

DETAILED DESCRIPTION OF THE DRAWINGS

Figure 2:
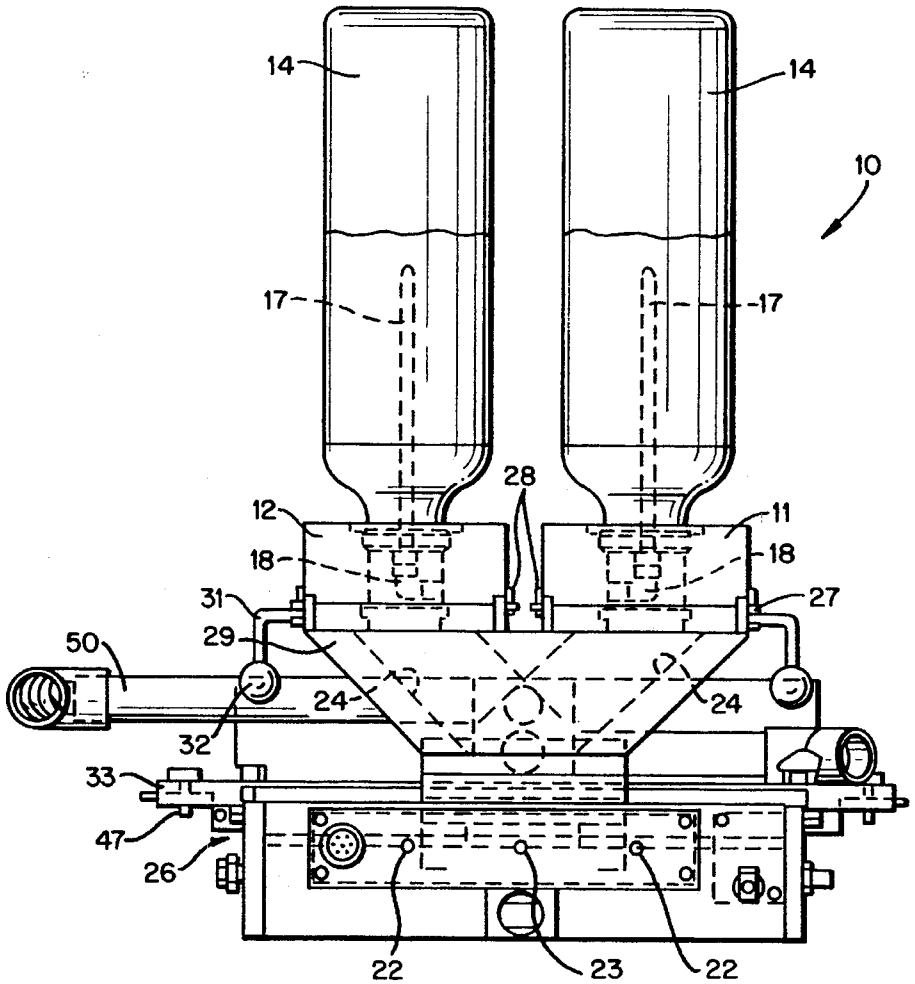
FIG. 2 is a rear view of the apparatus of FIG. 1.

An apparatus for supplying toner to an electrostatic printing apparatus, such as a MIDAX® printer, is shown generally by reference numeral 10 in FIGS. 1 through 3, 5, and 6.

The apparatus 10 includes a hopper assembly comprising first and second dispenser blocks 11, 12 each having a central passage 13 (see FIGS. 3 and 4) and means for receiving an open end of a toner bottle 14 (see FIGS. 1 and 2) within the passage 13. Such means include the portion of the dispenser block adjacent a top surface thereof, defining the passage 13. For example see the top surface 15 of the dispenser block 11 in FIG. 4. Note that the central passage 13 may be internally threaded, if desired in order to properly mesh with the open end of the toner bottle 14, adjacent the surface 15.

A screen 16 (see FIGS. 3 and 4) is provided in each of the blocks 11, 12, which are substantially identical. The screen 16 is of desired mesh (e.g. 60 mesh for some common toners) so that normally toner particles will not freely flow therethrough when in a pile above the screen 16, however when the toner particles are fluidized they will pass through the openings in the mesh 16. Also each of the assemblies 11, 12, comprises a gas permeable but toner substantially impermeable tube 17 which extends upwardly from the screen 16 to the interior of the toner bottle 14, extending upwardly about 30–60% of the height of the bottle 14 into the bottle 14. The tube 17 may be constructed of sintered metal, such as sintered stainless steel. It extends a distance into the bottle 14 significant enough to effect fluidization of toner in the bottle to effect discharge of the toner through the screen 16.

Gas under pressure (e.g. Compressed air) is supplied to the interior of each of the tubes 17 by a connection 18 (see the dotted line configurations in FIGS. 1 and 2) below the screen 16, which is connected through a solenoid valve 20' to a port 19, in turn connected up to a source of gas under pressure 20 (see FIG. 3). The solenoids, shown schematically at 20' in FIG. 8, are controlled by a Controller 21 (e.g. a microcomputer) which determines whether or not to feed air to a tube 17 to effect dispensing of toner particles from the bottle 14 associated therewith, and to which of the two blocks 11, 12 air will be fed at any particular point in time. The controller 21 operates so that air supplied to one of the blocks 11, 12 into the toner bottle 14 associated therewith is substantially empty, at which time it automatically switches over to the other block 11, 12. Switching will repeat as long as the block switched to has a bottle 14 with toner therein. If neither bottle 14 has toner therein, then an error message will be given.

Figure 3:
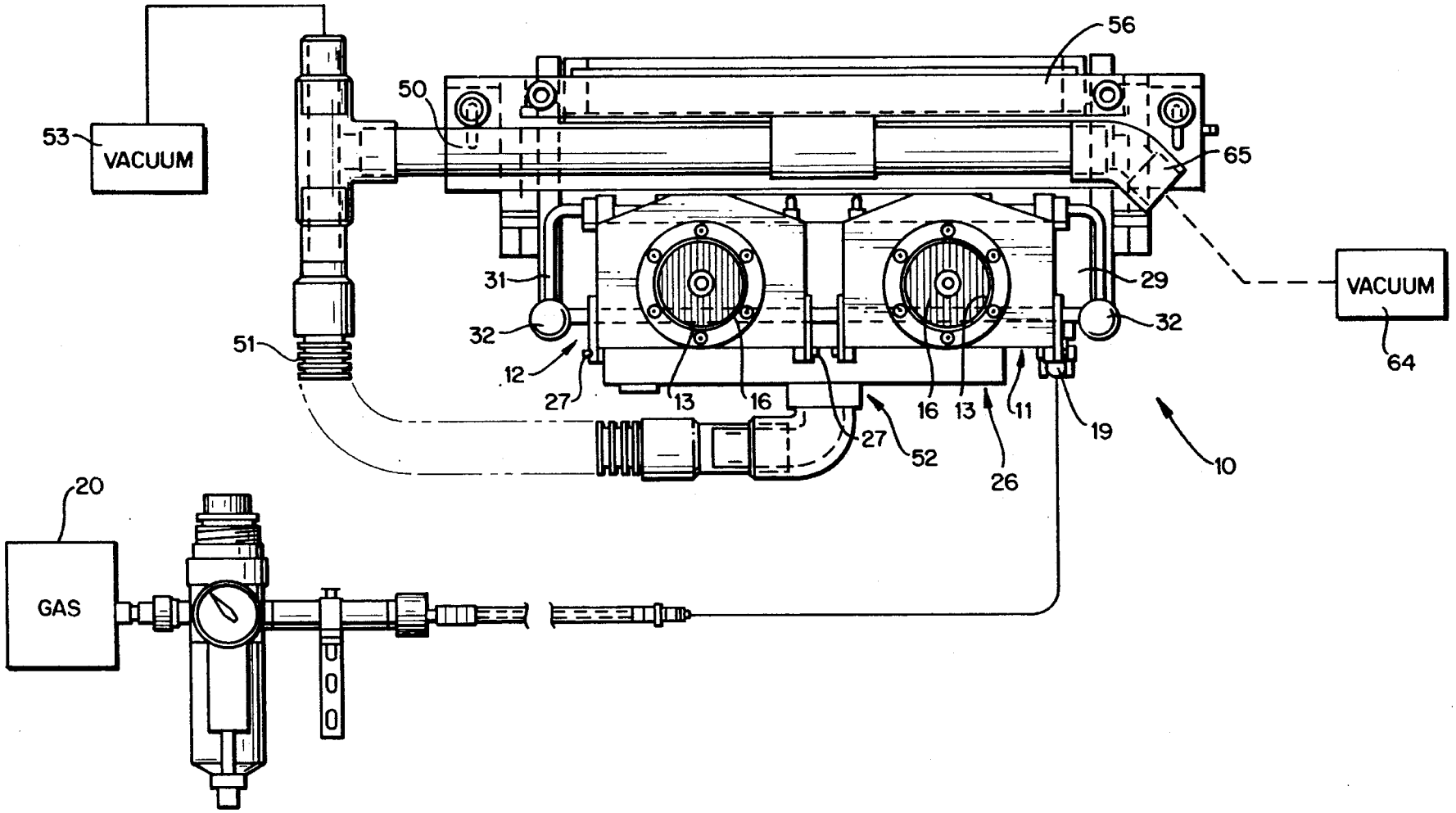
FIG. 3 is a top plan view of the apparatus of FIGS. 1 and 2 with the toner bottles removed for clarity of illustration.
Figure 5:
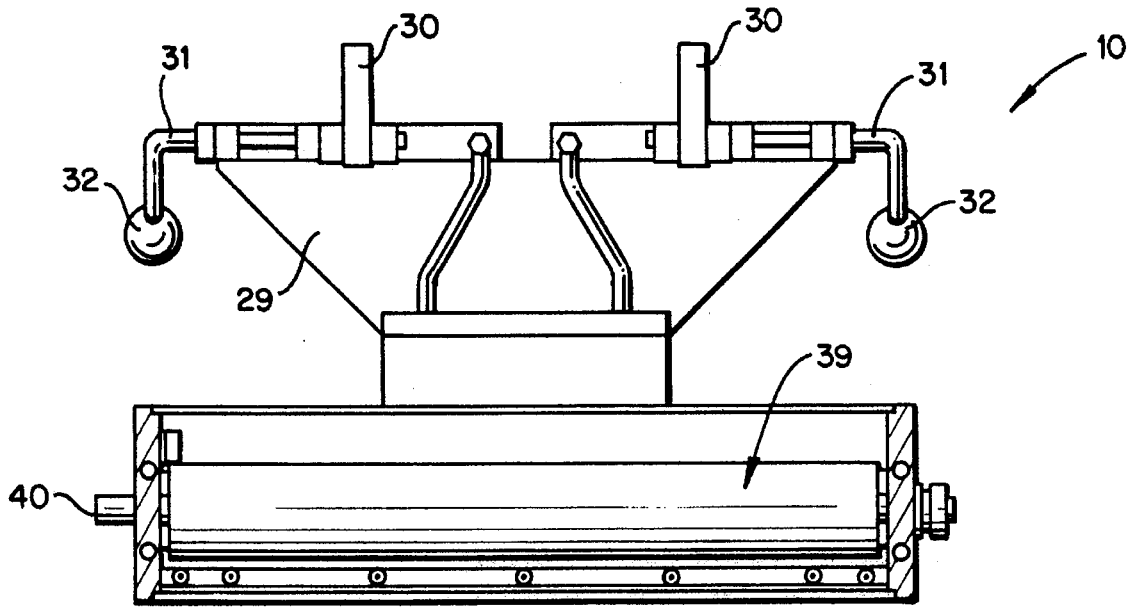
FIG. 5 is a front view of the apparatus of FIGS. 1 through 3 with the dispenser blocks and the declumping housing and the like removed for clarity of illustration.

As seen in FIG. 2, preferably indicator lights 22 are provided associated with the dispenser blocks 11, 12, respectively for indicating when toner is being dispensed from the bottle 14 associated with that block. Also a manually actuated switch, such as a toggle switch 23 (see FIGS. 2 and 8), may be provided for initially selecting which dispenser block 11, 12 will be connected up to the source of compressed gas 20.

External of each of the dispenser blocks 11, 12 for transporting magnetic and conductive toner from the bottle 14 associated therewith is a passageway, shown by reference numerals 24 in dotted line in FIG. 2. The passages 24 meet in a common chute, shown at 25 in FIG. 6, the chute 25 leading into a container shown generally by reference numeral 26 in FIGS. 1 through 3 and 6.

The blocks 11, 12 are mounted in association with the electrostatic printing apparatus, preferably in the manner illustrated in FIGS. 1 through 5. Each of the blocks 11, 12 has a pair of pivot pins 27 extending outwardly therefrom which are received by stationary pivot mounts 28 positioned on a housing component 29 underlying the blocks 11, 12. On the opposite end of each of the blocks 11, 12 from the pivot pins 27 is a mechanism (not shown) for receipt of a cam lock element 30 (see FIG. 5) which is moved between locking and unlocking positions by a rotatable shaft 31 having a handle 32.

Figure 1:
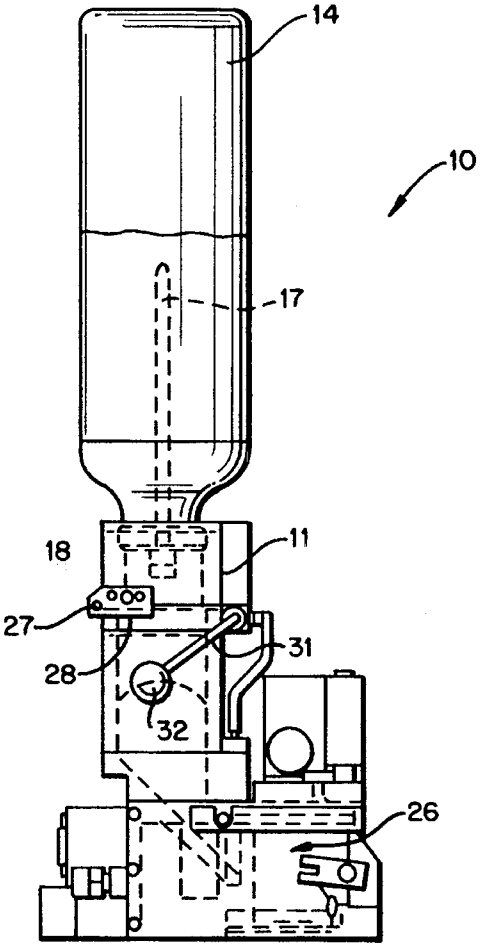
FIG. 1 is a side view of exemplary apparatus according to the present invention.

The elements 27, 28, and the cam mechanism 30–32 allow a block 11, 12 to be mounted in its operative position as illustrated in FIGS. 1 and 2, but then to be pivoted out of that position about the pivot pins 27, after the cam locks 30 have been disengaged by rotating the handles 32 once rotated about 90°, or slightly more, the pivot pin 27 can be disengaged from the mount 28, allowing the entire dispenser block (11 or 12) and the bottle 14 associated therewith to be moved to a new location, and allowing the empty bottle 14 to be replaced with a full bottle 14 while the open end of the bottle faces upwardly, so that toner will not be spilled.

The toner hopper mounting carriage 33 in combination with the vacuum conduit 50 allows removal of the unit and subsequent reinsertion without the necessity of reestablishing applicator roller to image cylinder gap. The carriage 33 is secured to the container 26 by fasteners 47 (see FIG. 2).

Within the container 26 there is maintained a fluidized bed, much in the same way as shown in Canadian patent 2059036. That is, the container 26 typically has solid side walls, and a false bottom 34 (see FIG. 6) which supports the toner particles thereon. The false bottom 34, which is substantially horizontal, is made of gas permeable and toner substantially impermeable material, such as sintered metal, or as otherwise described in Canadian patent 2059036. Gas (e.g. air) under pressure is supplied to a chamber 35 below the bottom 34, which flows through the bottom 34 to fluidize the toner thereabove, providing a fluidized bed at 36.

It is of course desirable to provide a sufficient supply of the magnetic and conductive toner within the fluidized bed 36. To ensure that a sufficient supply is provided, while not utilizing any mechanical components that act on the toner, a sensor for controlling the solenoids 20' is provided. The sensor is shown schematically at 37 in FIGS. 6 and 8, and preferably comprises an ultrasound emitter on one side of the discharge end of the chute 25, and an ultrasound receiver on the other side of the discharge end of the chute 25, the elements of the sensor 37 being supplied at the correct level (height in the container 26) in order to maintain an appropriate amount of toner in the fluidized bed 36. While an ultrasound sensor is desired, because of its reliability in a toner environment, photoelectric, capacitive, inductive, or like sensors could alternatively be provided.

Figure 6:
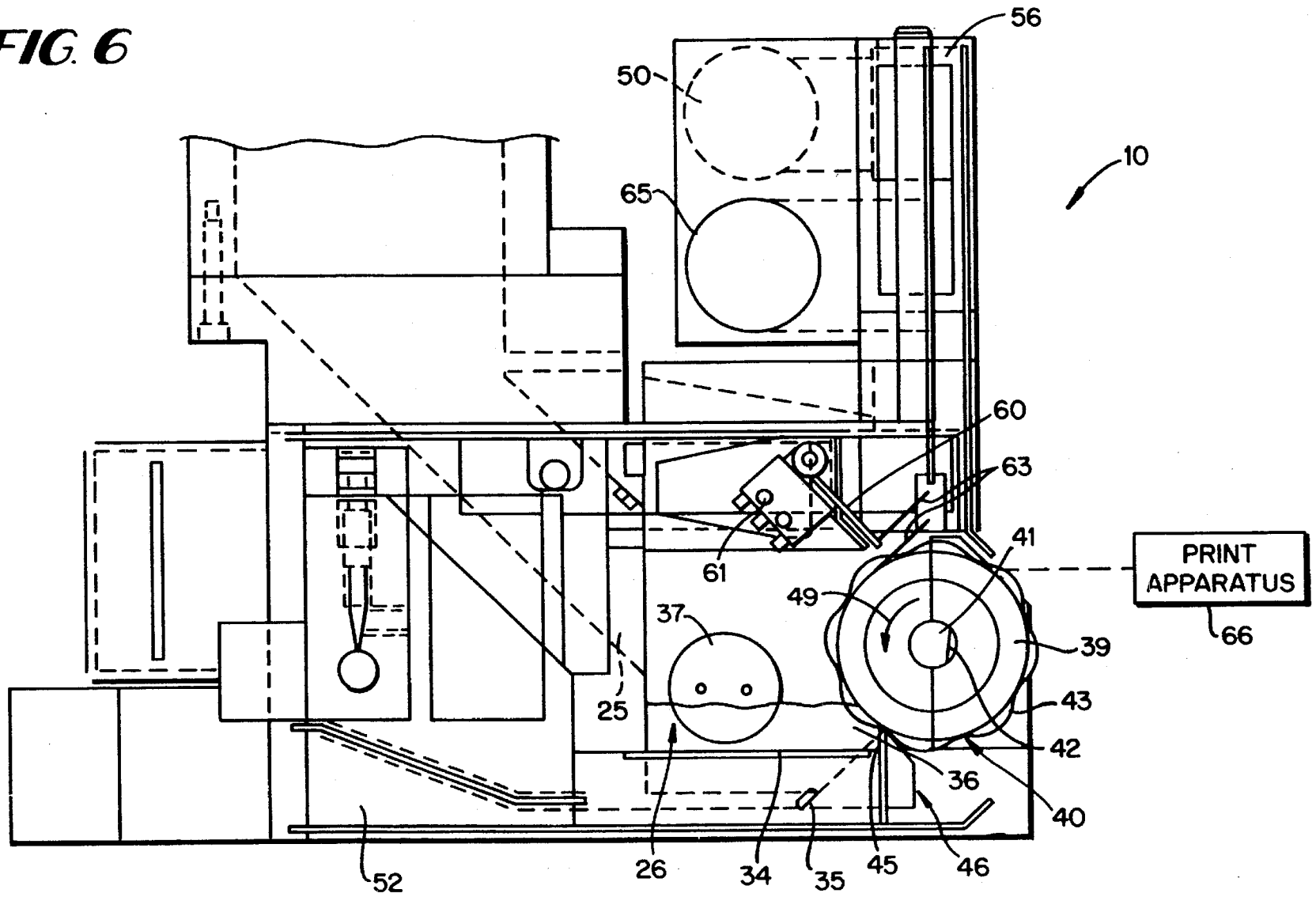
FIG. 6 is a detailed side view, like that of FIG. 1, only showing the details of the fluidized bed and related components, partly in cross-section and partly in elevation.

The fluidized toner—which has a minimum tendency to clump because of the fluidization thereof—is removed from the container 26 for transfer to the electrostatic printing apparatus by the applicator cylinder 39 (see FIG. 6). The cylinder 39 is the only mechanically moving element associated with the apparatus 10, thereby decreasing down time as well as the number of parts which can become non-operational due to clogging with toner. The applicator cylinder 39 has an external surface 40 thereof which is a non-magnetic type material (e.g. stainless steel) which allows the magnetic field created by permanent magnets within the roller 39 to attract the magnetic conductive particles of toner to the surface 40.

In a conventional applicator roller 39, the position of the stationary magnets at the center of the roller 39 are not fixed. However, it is desirable according to the invention to provide a lock that clamps the end of the magnetic assembly shaft 41. The shaft 41 is turned so that a set screw (not shown) in the lock tightens against the flat portion 42 of the shaft 41.

As is conventional, the roller 39 is hollow and of stainless steel. From the center of the roller 39, connected to the shaft 41, is a series of eight permanent magnets running nearly the full length of the roller 39. The magnets are equi-distant from each other and alternate in polarity, and cause the toner particles to form a series of peaks and troughs around the roll, as illustrated schematically by reference numeral 43 in FIG. 6. If the magnet angle goes out of adjustment the print quality can degrade and an excess of toner dusting can be observed. Magnet angle maladjustment can also change image density. With the magnet angle fixed at an optimum value by the set screw engaging the flat portion 42, this is unlikely to occur.

In order to control the amount of toner on the external surface 40 of the roller 39, a metering blade 45 of a metering blade assembly 46 (see FIG. 6) is provided. The position of the blade 45 with respect to the exterior surface 40 of the roller 39 is adjustable to control the amount of toner on the surface 40 (e.g. see 43) which moves out of the container 26.

The roller 39 is rotated by a reversible electric motor 48 (see FIG. 8) which drives the roller 39 through a gear belt or the like (not shown). The motor 48 normally rotates the roller 39 in the direction indicated by arrow 49 (see FIG. 6), but can rotate it in the opposite direction too. In order to control dusting by the toner, normally a low vacuum area is provided adjacent the roller 39, such as through the low vacuum conduit 50 (see FIGS. 2, 3 and 6), connected by branch conduit 51 (see FIG. 3) to a lower vacuum chamber 52 (see FIG. 6), the components 50–52 being connected up to a source of vacuum 53 shown schematically in FIG. 3.

Although because of the nature of the fluidized bed 36 clumping of toner rarely occurs, it is impossible to completely prevent. If poor imaging of the printing apparatus in one area indicates a clump, the print engine is shut down, and then a vacuum/declumping mechanism is actuated. The declumping mechanism, best seen in FIGS. 3, 6, and 7, include a depressible housing 56 normally biased upwardly by springs 57 (see FIG. 7), but reciprocal in the vertical dimension 58. A manually actuatable latch, shown only schematically at 59 in FIG. 7, is provided for normally holding the housing 56 in an upper, non-actuated position (to which it is biased by the springs 57), in which position a microswitch actuator 60 of the microswitch 61 (see FIGS. 6 through 8) is in a non-actuated position. However when the latch 59 is released and the housing 56 is depressed by the operator pushing downwardly on it, the microswitch 61 is actuated to cause the controller 21 to reverse the motor 48.

The housing 56 may be guided during its reciprocal movement in dimension 58, as indicated only schematically by the guide mechanism 62 in FIG. 7.

Provided on the bottom of the housing 56 are one or more declumping blades 63 (see FIG. 6), which are designed to scrape toner off of the surface 40 of roller 39 as the roller 39 is rotated in the direction opposite the direction 49. When the declumping feature is desired, a portable high vacuum source 64 is connected up to the high vacuum conduit 65 (see FIGS. 2, 3, 6, and 7), and the large pressure differential caused by the vacuum 64 sucks up any toner dislodged by the blades 63. However since the vacuum source 64 can easily empty all of the toner from the fluidized bed 36, the microswitch 61 also controls, through the controller 21, the solenoids 20' so that no toner is dispensed to the container 26 during the declumping operation, regardless of signals received from the ultrasound sensor 37.

When the declumping procedure is indicated, the print engine of the MIDAX printer or like electrostatic printing apparatus—shown only schematically by reference numeral 66 in FIG. 6—is shut down and the portable high pressure differential vacuum source 64 is connected up to the conduit 65, and grounded. The vacuum source 64 is then energized, the lever latch 59 deactuated, and the housing 56 pressed downwardly. When pressed downwardly, housing 56 actuates the actuator 60 of the microswitch 61, causing the motor 48 to reverse direction of the roller 39 while at the same time the blade or blades 63 are brought into contact with the surface 40, causing toner to be dislodged frown the surface 40, which toner is immediately sucked up by the vacuum source 64 and removed from the apparatus 10. This procedure is typically practiced only about 3–10 seconds (e.g. 4–5 seconds), at which time the pressure on housing 56 is released so that it moves upwardly under the bias of springs 57, and the vacuum source 64 is deactivated. Then the print apparatus 66 is started back up. If the image produced by the print apparatus 66 is still unacceptable, then the entire unit 10 must be vacuumed by hand.

Figure 9:
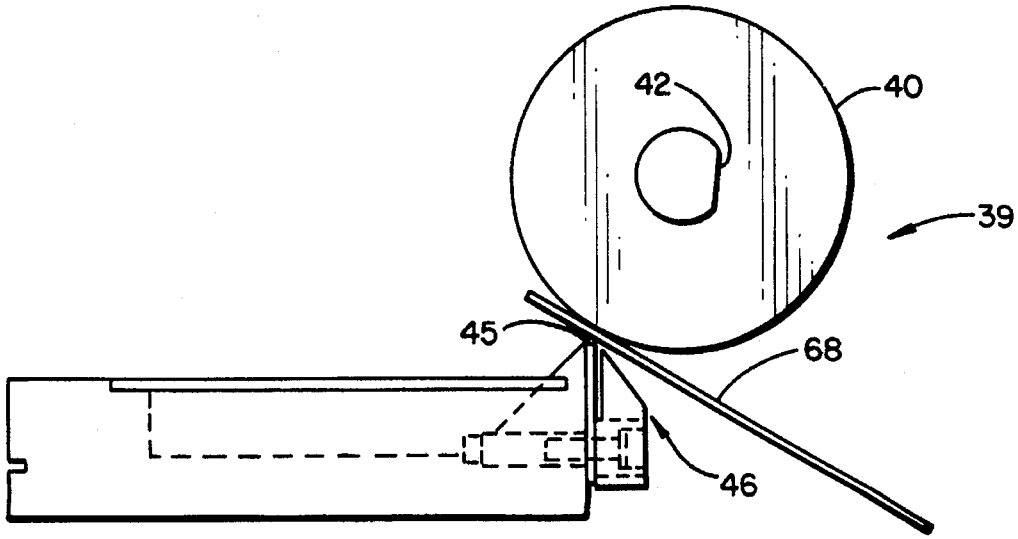
FIG. 9 is a is schematic side view showing the utilization of exemplary gating means according to the invention, shown in association with a metering blade and roller of the apparatus of FIG. 6.

If desired, the roller 39 also may have gating means associated therewith, so that when printing in a limited area the applicator roll 39 only is coated with toner for that area, not the entire roll. This may be accomplished utilizing the toner gate illustrated in FIG. 9. The metering blade assembly 46 is adapted to receive a plastic blade 68 made of shim stock (e.g. about 0.025 inches thick). The plastic blade 68 brushes against the applicator roller surface 40 to serve as a toner gate, allowing one to cut off toner from any desired non-printing area of the applicator roller 39. It is not necessary to loosen the metering blade clamp 46 in order to slide the gate 68 in.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A hopper assembly for supplying toner to an electrostatic printing apparatus, comprising:

a first dispenser block comprising a body having a central passage, means for receiving an open end of a toner bottle in said central passage, a screen in said central passage adjacent said toner bottle receiving means, and a gas permeable but toner substantially impermeable tube extending through said toner bottle receiving means a significant distance past said block, so as to penetrate into a bottle received by said toner bottle receiving means a distance significant enough to effect fluidization of toner in the bottle to effect discharge thereof through said screen;

means for mounting said first dispenser block in association with an electrostatic printing apparatus;

means for connecting said tube to a source of gas under pressure; and a passage exterior of said dispenser block for guiding toner from said screen to an electrostatic printing apparatus.

2. An assembly as recited in claim 1 further comprising a second dispenser block, substantially identical to said first dispenser block, including a tube; means for mounting said second dispenser block in association with the same electrostatic printing apparatus as said first block; means for connecting said tube of said second dispenser block to said source of gas under pressure; and further comprising control means for controlling supply of gas from said source of gas under pressure to said tubes of said dispenser blocks so that gas is supplied to neither of said blocks, or to a selected one of said blocks.

3. An assembly as recited in claim 1 wherein said gas permeable but toner substantially impermeable tube is sintered metal.

4. An assembly as recited in claim 2 further comprising a common chute extending from said dispenser blocks and leading to a fluidized bed; and sensing means located in the fluidized bed, adjacent said chute, for sensing toner therein.

5. An assembly as recited in claim 4 wherein said sensing means comprises an ultrasound emitter on one side of said chute and an ultrasound detector on the opposite side of said chute, in said fluidized bed.

6. An assembly as recited in claim 2 wherein said control means comprises a solenoid between said source of gas under pressure and each of said tubes.

7. An assembly as recited in claim 2 further comprising indicator means for indicating when a toner bottle associated with each of said dispenser blocks is being emptied.

8. An assembly as recited in claim 1 wherein said means for mounting said first dispenser block in association with an electrostatic printing apparatus comprises detachable pivot means for allowing pivotal movement of said dispenser block with respect to said electrostatic printing apparatus, and then removal of said dispenser block, after a certain degree of pivoting.

9. An assembly as recited in claim 2 wherein said means for mounting said first dispenser block in association with an electrostatic printing apparatus comprises detachable pivot means for allowing pivotal movement of said first dispenser block with respect to said electrostatic printing apparatus, and then removal of said first dispenser block, after a certain degree of pivoting;, and latch means for latching said first dispenser block in place.

10. An assembly as recited in claim 2 wherein said gas permeable but toner substantially impermeable tube is sintered metal.

11. An assembly as recited in claim 3 wherein said means for mounting said first dispenser block in association with an electrostatic printing apparatus comprises detachable pivot means for allowing pivotal movement of said dispenser block with respect to said electrostatic printing apparatus, and then removal of said dispenser block, after a certain degree of pivoting, and latch means for latching said dispenser block in place.

12. An assembly as recited in claim 4 wherein said control means comprises a solenoid between the source of gas under pressure and each of said tubes.

13. An assembly as recited in claim 12 further comprising indicator means for indicating when a toner bottle associated with each of said dispenser blocks is being emptied.

14. An assembly as recited in claim 4 further comprising indicator means for indicating when a toner bottle associated with each of said dispenser blocks is being emptied.

15. An assembly as recited in claim 9 further comprising a common chute extending from said dispenser blocks and leading to a fluidized bed; and sensing means located in the fluidized bed, adjacent said chute, for determining the amount of toner that is present.

16. An assembly as recited in claim 9 wherein said gas permeable but toner substantially impermeable tube is sintered metal.

17. An assembly as recited in claim 9 wherein said control means comprises a solenoid between the source of gas under pressure and each of said tubes.

18. An electrostatic printing apparatus comprising:

a supply of conductive magnetic toner;

a container for a fluidized bed of conductive magnetic toner;

means for automatically replenishing toner withdrawn from the fluidized bed from said supply;

means for fluidizing the tuner in said container;

a single applicator roller adjacent said container, and having an external surface thereof which extends into said container, said applicator roller including magnetic elements;

means for rotating said applicator roller about a horizontal axis; and a metering blade cooperating with said applicator roller external surface for metering the conductive magnetic toner on said external surface.

19. Apparatus as recited in claim 18 wherein said means for rotating said applicator roller comprises a reversible electric motor for rotation of said roller in a normal direction of rotation.

20. Apparatus as recited in claim 19 further comprising declumping means for removing clumped toner from said applicator roller, said declumping means comprising means for reversing the direction of rotation of said applicator roller with respect to the normal direction of rotation, means for scraping the exterior surface of the applicator roller as it is rotating, and means for simultaneously applying vacuum to the applicator roller to remove scraped toner from the exterior surface thereof.

21. Apparatus as recited in claim 18 wherein said supply of conductive magnetic toner comprises a hopper assembly, including: a first dispenser block comprising a body having a central passage, means for receiving an open end of a toner bottle in said central passage, a screen in said central passage adjacent said toner bottle receiving means, and a gas permeable but toner substantially impermeable tube extending through said toner bottle receiving means a significant distance past said block, so as to penetrate into a bottle received by said toner bottle receiving means a distance significant enough to effect fluidization of toner in the bottle to effect discharge thereof through said screen; and means for connecting said tube to a source of gas under pressure.

22. Apparatus as recited in claim 21 wherein said gas permeable toner substantially impermeable tube comprises a sintered stainless steel tube.

23. Apparatus as recited in claim 18 further comprising gating means for controlling the area of the applicator roller that is coated with toner for situations where the apparatus will only effect printing in a limited area.

24. A method of applying conductive and magnetic toner to an applicator roller having a magnetic member therein, comprising the steps of (a) supplying powdered conductive magnetic toner to a container to maintain a predetermined level therein;

(b) maintaining the powdered toner in a fluidized bed in the container by passing fluidizing gas through a gas permeable but toner impermeable horizontal surface; and (c) moving a non-magnetic rotating surface into operative association with the magnetic toner in the fluidized bed to collect toner thereon in the presence of magnetic fields from an internal magnetic member and remove it from the fluidized bed.

25. A method as recited in claim 24 wherein step (a) is practiced pneumatically, without any mechanical elements engaging the toner.

26. A method as recited in claim 25 wherein step (a) is further practiced by fluidizing the toner and passing it through a screen having a size such that the toner would not normally pass through the screen unless it were fluidized.

27. A method as recited in claim 24 wherein step (c) is practiced by rotating an applicator roller with permanent magnets therein so that the external surface thereof moves into contact with fluidized powdered conductive magnetic toner in the fluidized bed.

28. A method as recited in claim 27 comprising the further step of periodically declumping toner by removing it from the applicator roller external surface.

29. A method of declumping an applicator roller, having an external surface, of an electrostatic printer, which roller normally rotates in a first direction, comprising the steps of:

(a) temporarily reversing the direction of rotation of the applicator roller so that it rotates in a second direction opposite the first direction; and (b) while practicing step (a), automatically scraping the exterior surface of the applicator roller while simultaneously applying vacuum thereto, to remove toner from the exterior surface.

30. A method as recited in claim 29 wherein steps (a) and (b) are practiced for about 3–10 seconds.

31. A method as recited in claim 30 wherein steps (a) and (b) are practiced by manually depressing a reciprocal element having a scraping blade thereon and a source of vacuum operatively connected thereto.

32. A method of applying conductive and magnetic toner to an applicator roller having a magnetic member therein, comprising the steps of:

(a) supplying powdered conductive magnetic toner to a container to maintain a predetermined level therein, without any mechanical elements engaging the toner including by fluidizing the toner and passing it through a screen having a size such that the toner would not normally pass through the screen unless it were fluidized;

(b) maintaining the powdered toner in a fluidized bed in the container; and (c) moving a non-magnetic rotating surface into operative association with the magnetic toner in the fluidized bed to collect toner thereon in the presence of magnetic fields from an internal magnetic member and remove it from the fluidized bed.

33. A method of applying conductive and magnetic toner to an applicator roller having a magnetic member therein, comprising the steps of:

(a) supplying powdered conductive magnetic toner to a container to maintain a predetermined level therein;

(b) maintaining the powdered toner in a fluidized bed in the container; and (c) moving a non-magnetic rotating surface into operative association with the magnetic toner in the fluidized bed to collect toner thereon in the presence of magnetic fields from an internal magnetic member and remove it from the fluidized bed, by rotating an applicator roller with permanent magnets therein so that the external surface thereof moves into contact with fluidized powdered conductive magnetic toner in the fluidized bed; and (d) periodically declumping toner by removing it from the applicator roller external surface.

34. A method as recited in claim 33 wherein said step of periodically declumping toner is practiced by reversing rotation of the applicator roller for about 3–10 seconds while simultaneously bringing a scraping blade into contact with the external surface, and applying a vacuum to the area surrounding the scraping blade; and wherein during the practice of said declumping step, step (a) is arrested so that additional toner is not supplied to the container.

* * * * *